US008888518B2

(12) United States Patent
Takahashi et al.

(10) Patent No.: US 8,888,518 B2
(45) **Date of Patent: *Nov. 18, 2014**

(54) ROTARY CONNECTOR

(71) Applicant: Alps Electric Co., Ltd., Tokyo (JP)

(72) Inventors: Seishi Takahashi, Miyagi-Ken (JP); Toshiaki Asakura, Miyagi-Ken (JP); Hiroyuki Sato, Miyagi-Ken (JP); Yasuhisa Osumi, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 70 days.

This patent is subject to a terminal disclaimer.

(21) Appl. No.: 13/788,559

(22) Filed: Mar. 7, 2013

(65) Prior Publication Data

US 2013/0237099 A1 Sep. 12, 2013

(51) Int. Cl.

| | |
|---|---|
| ***H01R 39/00*** | (2006.01) |
| ***H01R 24/28*** | (2011.01) |
| ***H01R 12/59*** | (2011.01) |
| ***H01R 35/02*** | (2006.01) |
| *H01R 4/02* | (2006.01) |
| *H01R 43/02* | (2006.01) |

(52) U.S. Cl.

CPC ..... *H01R 24/28* (2013.01); *H01R 12/592* (2013.01); *H01R 35/025* (2013.01); *H01R 4/023* (2013.01); *H01R 43/0221* (2013.01); *H01R 2201/26* (2013.01)

USPC ..... 439/164

(58) Field of Classification Search

USPC ..... 439/164, 15

See application file for complete search history.

(56) References Cited

U.S. PATENT DOCUMENTS

| | | | | |
|---|---|---|---|---|
| 5,286,218 | A | 2/1994 | Sakurai et al. | |
| 5,962,813 | A * | 10/1999 | Shirako et al. | 174/88 R |
| 6,023,022 | A * | 2/2000 | Nakamura et al. | 174/88 R |
| 6,232,556 | B1 | 5/2001 | Daugherty et al. | |
| 6,494,396 | B2 * | 12/2002 | Sugata | 242/388.5 |
| 6,547,606 | B1 * | 4/2003 | Johnston et al. | 439/708 |

(Continued)

FOREIGN PATENT DOCUMENTS

| | | |
|---|---|---|
| EP | 1145916 A2 | 10/2001 |
| EP | 1257019 A2 | 11/2002 |

(Continued)

OTHER PUBLICATIONS

Extended European Search Report issued in corresponding European Patent Application No. 13151191.7, mailed Jun. 14, 2013, 8 pages.

*Primary Examiner* — Neil Abrams
(74) *Attorney, Agent, or Firm* — Brinks Gilson & Lione

(57) ABSTRACT

After a lead block, which is assembled by fitting a required number of pin terminals into an insulating support member, is connected to an end portion of a flat cable, the lead block is mounted on a lower connector holding portion of a rotary connector. The lower connector holding portion is formed of downward protruding portions of an outer cylindrical portion and a lower cover that are snap-fitted to each other. The downward protruding portion includes a receiving recess, and the downward protruding portion includes a holding wall portion. Tip portions of the pin terminals are inserted into insertion holes of the holding wall portion, so that the lead block is mounted. While stopper portions of the pin terminals are interposed between the holding wall portion and an outer wall of the support member, the support member is disposed so as to be positioned the receiving recess.

7 Claims, 8 Drawing Sheets

(56) References Cited

U.S. PATENT DOCUMENTS

| | | | | |
|---|---|---|---|---|
| 6,644,978 | B2 * | 11/2003 | Araki | 439/15 |
| 6,733,300 | B2 * | 5/2004 | Oguma | 439/15 |
| 8,678,835 | B2 * | 3/2014 | Takahashi et al. | 439/13 |
| 2004/0053517 | A1 | 3/2004 | Durocher et al. | |
| 2010/0124851 | A1 | 5/2010 | Xiong et al. | |

FOREIGN PATENT DOCUMENTS

| | | | |
|---|---|---|---|
| EP | 1273481 | A2 | 1/2003 |
| EP | 2500994 | A1 | 9/2012 |
| JP | 11-097088 | | 4/1999 |
| JP | 11097088 | | 4/1999 |

* cited by examiner

ROTARY CONNECTOR

CLAIM OF PRIORITY

This application claims benefit of Japanese Patent Application No. 2012-053487 filed on Mar. 9, 2012, which is hereby incorporated by reference in its entirety.

BACKGROUND

1. Field of the Disclosure

The present disclosure relates to a rotary connector having a structure where flat cables are wound in an annular space between a movable-side housing and a stationary-side housing, and more particularly, to a rotary connector that includes a lead block in which a plurality of pin terminals connected to a flat cable are arranged in parallel and held.

2. Description of the Related Art

In a rotary connector that is assembled with a steering device of an automobile and used as electrical connection means of an air bag system and the like, an annular space is formed between a movable-side housing and a stationary-side housing rotatably connected to each other and a flat cable is received in the annular space while being wound. Lead blocks, which are electrically connected to the outside, are connected to both end portions of the flat cable, respectively. The lead block, which is connected to one end portion of the flat cable, is mounted on the movable-side housing of the rotary connector, which is rotated integrally with a steering wheel, and is connected to an external connector that is led from an air bag system, a horn circuit, and the like provided on the steering wheel. Further, the lead block, which is connected to the other end portion of the flat cable, is mounted on the stationary-side housing of the rotary connector, and is connected to an external connector that is led from an electrical device provided on a vehicle body.

The lead block, which has been employed in the past in the rotary connector having the above-mentioned schematic structure, has a structure where the lead block, except for external joint portions close to tip portions of a plurality of conductors arranged in parallel and internal joint portions close to base end portions of the conductors, is coated with an insulating material and the internal joint portions of the respective conductors are exposed to welding hole portions of the insulating material. Accordingly, the lead block has been manufactured by insert molding. Further, the flat cable has a structure where a plurality of parallel belt-like conductors are exposed to the outside at both end portions. The lead block is superimposed on one surface of the flat cable so that the belt-like conductors of the flat cable and belt-like conductors of the lead block cross each other. Exposed portions of the belt-like conductors and the conductors exposed to the welding hole portions are connected to each other by welding (for example, see Japanese Unexamined Patent Application Publication No. 11-97088).

As described above, the lead block, which is used in the rotary connector in the related art, is manufactured by insert molding that requires a complicated mold. Accordingly, the manufacturing costs of the lead block are increased. For this reason, there is a problem in that it is difficult to reduce the costs of the rotary connector.

SUMMARY

A rotary connector includes a movable-side housing, a stationary-side housing, a flat cable, and a lead block. The movable-side housing and a stationary-side housing are rotatably connected to each other. The flat cable comprising a plurality of belt-like conductors, which are arranged in parallel, except for connection portions, coated with a pair of insulating films and received in an annular space formed between both the housings while being wound. The lead block is connected to the connection portions of the flat cable and is electrically connected to the outside. The lead block comprising a plurality of pin terminals arranged in parallel in an insulating support member. The flat cable and the lead block are superimposed so that the plurality of pin terminals and the plurality of belt-like conductors cross each other. The plurality of pin terminals include joint portions that are connected to the connection portions of the flat cable and are close to base end portions, fitting portions that are held by being fitted to the support member, restricting portions that come into contact with an outer wall of the support member, and tip portions that protrude outward from the restricting portions. At least one of the movable-side housing and the stationary-side housing includes a receiving portion in which the lead block is received and a holding wall portion that includes insertion holes into which tip portions of the plurality of pin terminals are inserted, and the restricting portions are directly or indirectly interposed between the holding wall portion and the support member while the lead block is received.

According to such a structure, the plurality of pin terminals can be fitted to and held in the insulating support member and the lead block does not need to be formed by insert molding using a mold having a complicated structure. Accordingly, it is possible to provide a rotary connector of which not only the costs of the lead block can be significantly reduced but also the costs can be reduced. Further, while the lead block is received in the receiving portion of the rotary connector, the restricting portions of the respective pin terminals are interposed between the support member and the holding wall portion. Accordingly, when an external connector is connected to or disconnected from the respective pin terminals, it is possible to receive an external force (a pushing force or a pulling force), which is applied to the respective pin terminals, by the support member, the holding wall portion, the inner surface of the receiving portion, and the like through the restricting portions. Therefore, there is no concern that the respective pin terminals are separated from the support member by an external force generated at the time of the connection and disconnection of the external connector or a conduction failure is caused by the separation of a welded portion between the pin terminal and the flat cable (belt-like conductor), and the like. As a result, it is possible to suppress the occurrence of a problem in the assembly, so that it is possible to improve the reliability of the rotary connector.

DESCRIPTION OF THE EXEMPLARY EMBODIMENTS

Figure 1:
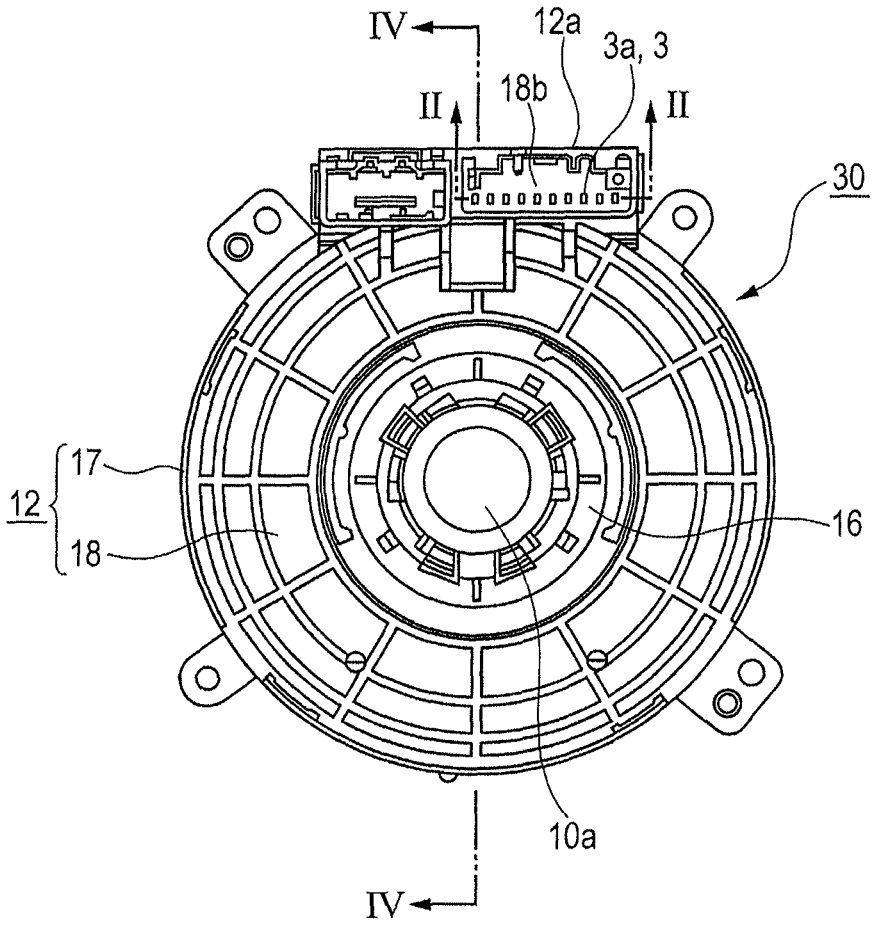
FIG. 1 is a bottom view of a rotary connector according to a first embodiment of the invention.
Figure 4:
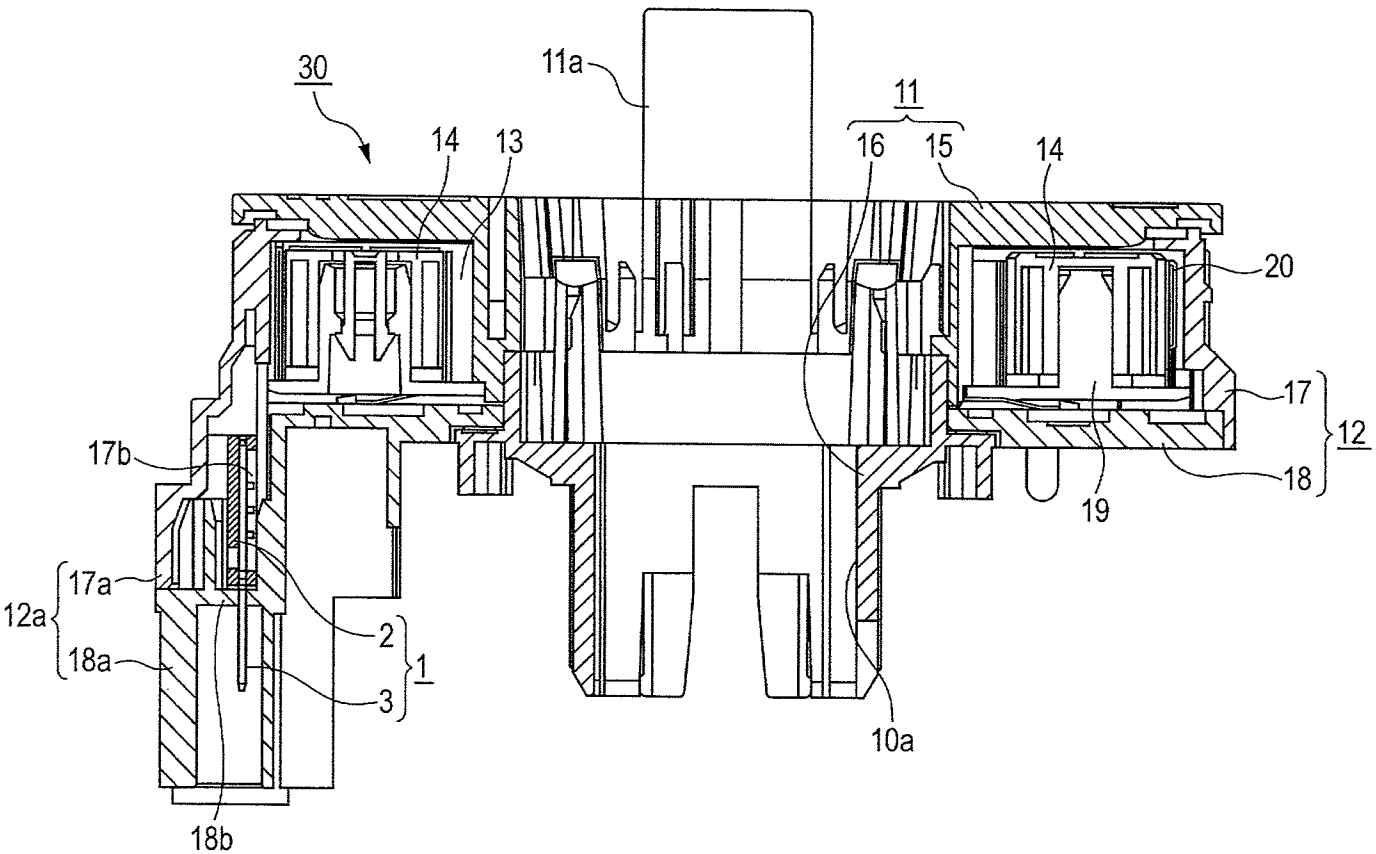
FIG. 4 is a cross-sectional view taken along line IV-IV of FIG. 1.

Embodiments of the invention will be described below with reference to the drawings. As shown in FIGS. 1 and 4, a rotary connector 30 according to a first embodiment of the invention has a structure where a movable-side housing 11 rotated integrally with a steering wheel (not shown) and a stationary-side housing 12 mounted on a steering column or the like are rotatably connected to each other and a flat cable 20 is received in an annular space 13 formed between both the housings 11 and 12 while being wound. The rotary connector 30 is assembled in a steering device of an automobile and is used as electrical connection means of an air bag system or the like. Meanwhile, a steering shaft (not shown) is inserted into a center hole 10*a* of the rotary connector 30.

The movable-side housing 11 is formed of an upper rotor 15 and a lower rotor 16 that are integrated with each other by snap-fitting. A lead block (not shown) is assembled in an upper connector holding portion 11*a* that protrudes upward in FIG. 4. The stationary-side housing 12 is formed of an outer cylindrical portion 17 and a lower cover 18 that are integrated with each other by snap-fitting. A lead block 1 to be described below is assembled in a lower connector holding portion 12*a* that protrudes downward. Further, a plurality of rollers 14 which guide an operation for winding and rewinding the flat cable 20 and a roller holder 19 by which the rollers 14 are rotatably held are assembled in the annular space 13.

One end portion (outer end portion) of the flat cable 20 is connected to the lead block 1, and the lead block 1 is held by the lower connector holding portion 12*a* of the stationary-side housing 12. As shown in FIG. 4, the lower connector holding portion 12*a* is formed by the combination of a downward protruding portion 17*a* (second case body) of the outer cylindrical portion 17 and a downward protruding portion 18*a* (first case body) of the lower cover 18. An external connector, which is led from an electrical device provided on a vehicle body, is connected to the lead block 1. Further, the other end portion (inner end portion) of the flat cable 20 is connected to a lead block (not shown), and the lead block is held by the upper connector holding portion 11*a* of the movable-side housing 11. An external connector, which is led from an air bag system, a horn circuit, and the like provided on the steering wheel, is connected to the lead block (not shown).

Figure 2:
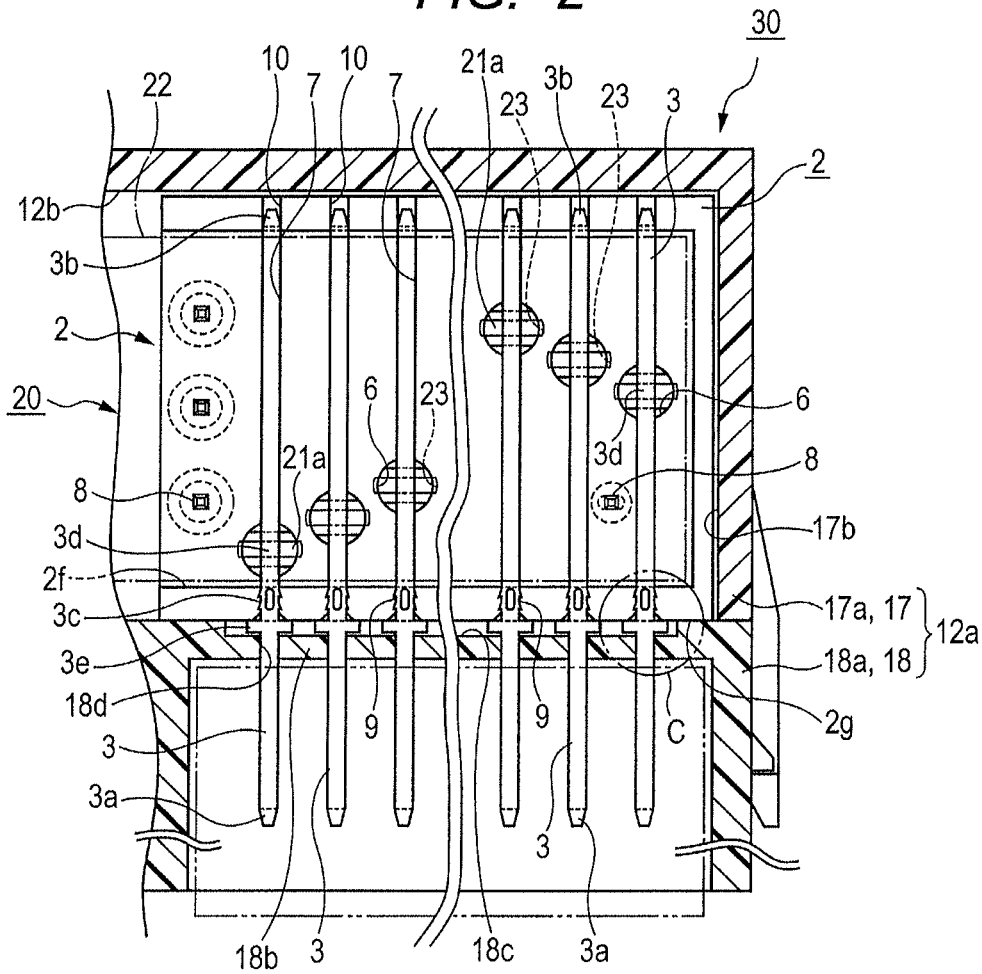
FIG. 2 is a view showing main portions of a part of the structure of a cross section taken along line II-II of FIG. 1.
Figure 6:
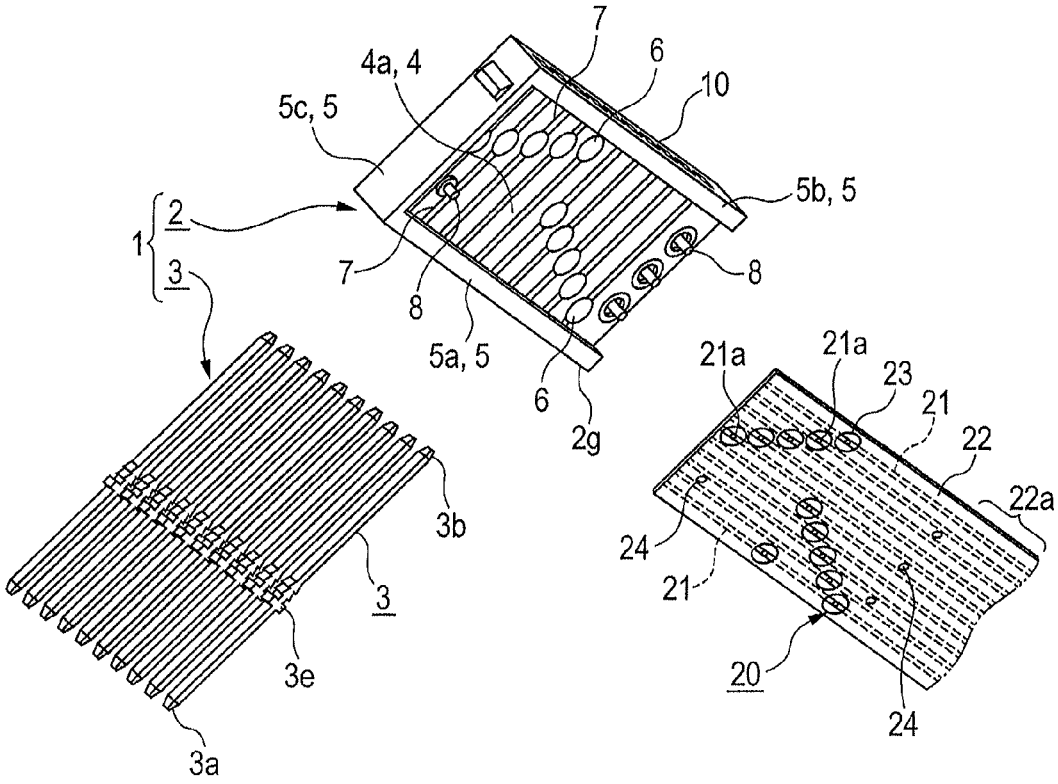
FIG. 6 is an exploded perspective view of the lead block and a flat cable shown in FIG. 2.

As shown in FIGS. 2 and 6, the flat cable 20 is a belt-like body that is called a flat cable and is formed by coating a plurality of belt-like conductors 21, which are arranged in parallel, with a pair of insulating films 22. Conductor exposure holes 23 through which a part (connection portions 21*a*) of the respective belt-like conductors 21 are exposed to the outside and through holes 24 into which positioning protrusions 8 formed on the lead block 1 are inserted are formed in the insulating films 22 at the end portion of the flat cable 20. A long portion 22*a*, which forms a portion of the flat cable 20 between both the end portions of the flat cable 20, is received in the annular space 13 of the rotary connector 30 (FIG. 4), and the long portion 22*a* is subjected to a winding operation or a rewinding operation with the rotation of the movable-side housing 11. Meanwhile, FIG. 6 is an exploded perspective view when seen from the back side of the plane of FIG. 2.

As shown in FIGS. 2 and 4, the lead block 1 includes a support member 2 that is formed of a molding made of an insulating resin, and a plurality of pin terminals 3 that are held by being fitted and fixed to the support member 2. The respective straight pin terminals 3 are arranged in parallel in the support member 2. Jetty portions 5 (5*a*, 5*b*, and 5*c*) are erected from the support member 2 along three sides of a rectangular bottom plate 4, that is, three sides of the rectangular bottom plate 4 except for one side of the rectangular bottom plate 4 that is a portion through which the flat cable 20 extends to the outside. The flat cable 20 is disposed so as to be superimposed on an inner surface portion 4*a* of the bottom plate 4 forming a region within the jetty portions 5 so that the respective belt-like conductors 21 of the flat cable 20 and the respective pin terminals 3 of the support member 2 are orthogonal to each other (cross each other). Further, the connection portions 21*a* of the belt-like conductors 21 that are exposed to the outside through the conductor exposure holes (hole portions) 23 of the flat cable 20 and joint portions 3*d* of the pin terminals 3 that cross above the conductor exposure holes 23 are connected to each other by welding as described below. Meanwhile, one side of the support member 2 where no jetty portion 5 is formed forms an open end portion 2*f* (see FIG. 2) that guides the long portion 22*a* of the flat cable 20 to the annular space 13. When the lead block 1 is assembled in the lower connector holding portion 12*a*, the open end portion 2*f* is adjacent to an opening 12*b* formed at the lower connector holding portion 12*a* of the stationary-side housing 12 (see FIG. 2).

Figure 5:
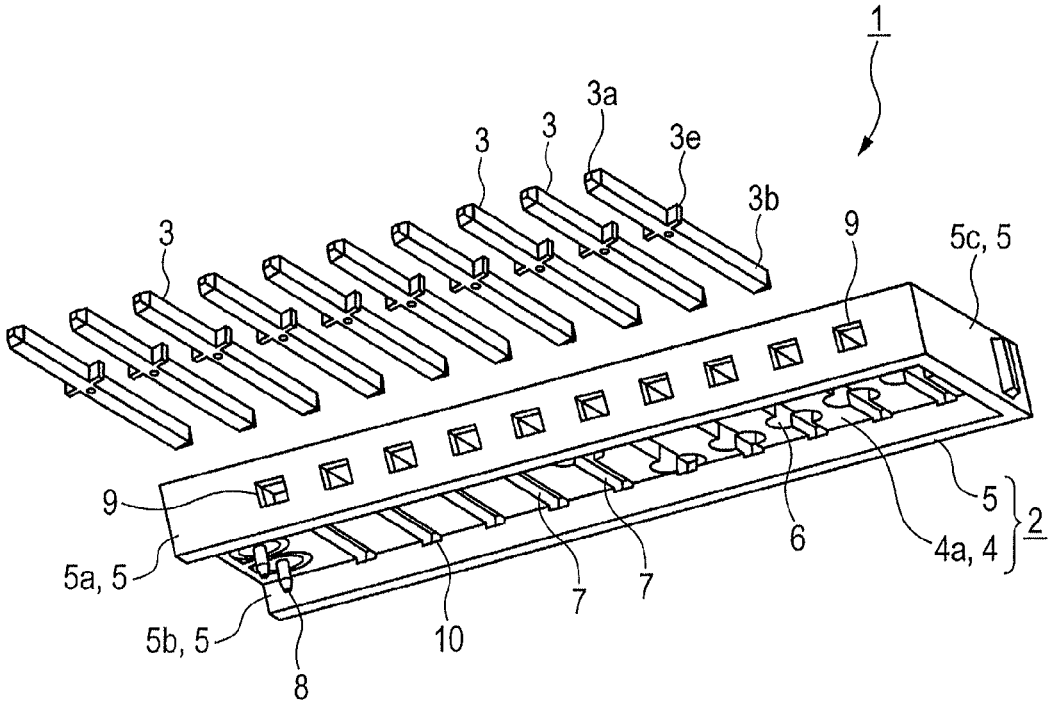
FIG. 5 is an exploded perspective view of a lead block shown in FIG. 2.

As shown in FIGS. 2 and 5, a plurality of mounting hole portions 9 (first holding portions) are formed at intervals in the jetty portion 5*a*, which is formed along one of two long sides of the support member 2 facing each other, that is, the long side of the support member 2 positioned close to the tip portions 3*a* of the pin terminals 3 shown in FIG. 2, among the jetty portions 5 of the support member 2. These mounting hole portions 9 hold and fix the respective pin terminals 3 while the respective pin terminals 3 are inserted and fitted to the mounting hole portions 9 from base end portions 3*b*. Further, fitting portions 10 (second holding portions) to which the base end portions 3*b* of the respective pin terminals 3 are fitted are formed at regular intervals in the jetty portion 5*b*, which is formed along the other side of the support member 2, among the jetty portions 5. When the base end portions 3*b* of the respective pin terminals 3 are fitted into these fitting portions 10, the respective pin terminals 3 are arranged in parallel in the support member 2. Here, the respective mounting hole portions 9 and the respective fitting portions 10 face each other.

Furthermore, the bottom plate 4 of the support member 2 is provided with a plurality of exposure hole portions 6 through which portions of the respective pin terminals 3 crossing the conductor exposure holes 23 of the flat cable 20, that is, the back-side portions of the joint portions 3*d* are exposed to the outside and the plurality of positioning protrusions 8 that are inserted into the through holes 24 formed at the end portion of the flat cable 20. When, for example, the joint portions 3*d* of the respective pin terminals 3 and the connection portions 21*a* of the belt-like conductors 21 of the flat cable 20 are spot-welded to each other as described below, electrodes of a spot welder are inserted into the exposure hole portions 6. Moreover, the positioning protrusions 8 are inserted into the through holes 24 and caulked, so that the end portion of the flat cable 20 is positioned on the bottom plate 4 of the support member 2 and fixed to the bottom plate 4. Meanwhile, guide grooves 7, which make the respective pin terminals 3 fitted from the respective mounting hole portions 9 be arranged in parallel and guide the pin terminals 3 so that the surfaces of the respective pin terminals 3 are exposed to the outside, are formed on the inner surface portion 4*a* of the support member 2. Accordingly, since the guide grooves 7 are formed, the respective pin terminals 3 can be smoothly fitted to the support member 2 so as to be arranged parallel to each other. Therefore, it is possible to easily assemble the lead block 1. Meanwhile, if the width of the guide groove 7 is set so that each pin terminal 3 can be press-fitted to the guide groove 7, the guide groove 7 also functions as a holding portion for holding each pin terminal 3. Accordingly, the guide grooves 7 can be applied instead of the fitting portions 10.

Figure 3:
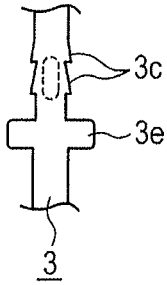
FIG. 3 is an enlarged view of a portion C of FIG. 2.

As shown in FIGS. 2 and 5, each of the linear pin terminals 3 includes a stopper portion 3*e* (restricting portion) between the tip portion 3*a* and the base end portion 3*b* and the stopper portion 3*e* is formed in the shape of a flange that has a width larger than the width of mounting hole portion 9 of the support member 2. While the base end portion 3*b* of each pin terminal 3 is fitted to the fitting portion 10, the stopper portion 3*e* comes into contact with and is locked into the peripheral portion of the mounting hole portion 9, that is, an outer wall 2*g* of the jetty portion 5*a*. Accordingly, the stopper portion 3*e* has a function of setting the length of a portion of each pin terminal 3 that is fitted to the support member 2. Further, wedge-shaped portions 3*c* (fitting portions) are formed on each pin terminal 3 at positions corresponding to the mounting hole portion 9 in the state shown in FIG. 2, that is, near the base end of the stopper portion 3*e* (see FIG. 3). When each pin terminal 3 is fitted to the mounting hole portion 9 so that the stopper portion 3*e* comes into contact with the outer wall 2*g* (jetty portion 5) of the support member 2, the wedge-shaped portions 3*c* bite into the inner surface of the mounting hole portion 9. Accordingly, since the wedge-shaped portion 3*c* has a function of solidly holding each pin terminal 3 on the support member 2 and a function of increasing the mounting strength and mounting position accuracy of each pin terminal 3 on the support member 2, it is possible to easily manufacture the lead block 1 without problems. Meanwhile, the stopper portion 3*e* has been formed in the shape of a wide flange so as to come into contact with and be locked into the peripheral portion of the mounting hole portion 9, but may be formed in the shape of a protrusion. When the lead block 1 is received in a receiving recess 17*b* (receiving portion) of the lower connector holding portion 12*a* as shown in FIGS. 2 and 4, the stopper portions 3*e* are interposed between a holding wall portion 18*b* of the downward protruding portion 18*a* (lower cover 18) and the outer wall 2*g* of the support member 2. Accordingly, the mounting strength of each pin terminal 3 on the rotary connector 30 is further increased. This will be described in detail below, but the stopper portion 3*e* formed on each pin terminal 3 functions as a restricting portion in the case of the lead block 1 of this embodiment.

Meanwhile, since the basic structure of the lead block (not shown), which is held by the movable-side housing 11, is also the same as that of the above-mentioned lead block 1, a required number of pin terminals are press-fitted and fixed to a support member.

Next, a procedure for connecting the flat cable 20 to the lead block 1 will be described. When one end portion of the flat cable 20 is to be connected to the lead block 1, first, the end portion of the flat cable 20 is disposed on the inner surface portion 4*a* (bottom plate 4) of the support member 2 and the positioning protrusions 8 are inserted into the through holes 24. Accordingly, the end portion of the flat cable 20 is positioned relative to the support member 2 and the respective conductor exposure holes 23 are disposed immediately above the respective exposure hole portions 6. When the positioning protrusions 8 are thermally caulked in this state, the flat cable 20 is fixed to the bottom plate 4 of the support member 2 while being positioned on the bottom plate 4. Then, electrodes (not shown) of a spot welder are inserted into the exposure hole portion 6 and the conductor exposure hole 23, the joint portion 3*d* of the pin terminal 3 and the connection portion 21*a* of the belt-like conductor 21 come into press contact with each other, and the pair of electrodes apply current to the joint portion 3*d* and the connection portion 21*a* to perform spot welding. As a result, the joint portion 3*d* and the connection portion 21*a* are welded to each other. Meanwhile, a procedure for connecting the other end portion of the flat cable 20 to the lead block (not shown) is the same as the above-mentioned procedure.

After being connected to the end portion (outer end portion) of the flat cable 20, the lead block 1 is assembled in the lower connector holding portion 12*a* of the stationary-side housing 12. As shown in FIGS. 2 and 4, the receiving recess 17*b* in which the support member 2 can be disposed so as to be positioned is formed in the downward protruding portion 17*a* forming the lower connector holding portion 12*a*. Further, the holding wall portion 18*b*, which extends along the lower surface of the support member 2 of the lead block 1, that is, the outer wall 2*g* of the jetty portion 5*a* positioned close to the tip portions 3*a* of the pin terminals 3, is formed in the downward protruding portion 18*a* of the lower cover 18. A recessed step 18*c* in which the stopper portions 3*e* of the respective pin terminals 3 are disposed and a plurality of insertion holes 18*d* that are formed closer to the tip of each pin terminal 3 than the stopper portion 3*e* of each pin terminal 3 so as to individually pass through the holding wall portion 18*b* are formed in the holding wall portion 18*b*. According to such a structure, the stopper portions 3*e* of the respective pin terminals 3 are interposed between the holding wall portion 18*b* of the downward protruding portion 18*a* and the outer wall 2*g* of the support member 2. Accordingly, even though a large external force (a pushing force or a pulling force) is applied to the pin terminals 3 when an external connector is connected to or disconnected from the respective pin terminals 3 protruding outward from the insertion holes 18*d* of the holding wall portion 18*b*, not only there is no concern that the pin terminals 3 are separated from the support member 2 and but also there is no concern that a conduction failure is caused by the separation of a welded portion between the joint portion 3*d* of the pin terminal 3 and the connection portion 21*a* of the belt-like conductor 21 of the flat cable 20. Accordingly, it is possible to connect and disconnect the external connector to and from the rotary connector 30 without problems. Meanwhile, since the recessed step 18*c* formed on the holding wall portion 18*b* is formed so as to have a depth where the stopper portion 3*e* and the outer wall 2*g* of the jetty portion 5*a* come into contact with each other, a portion, on which the recessed step 18*c* is not formed and which faces the support member 2, of the surface of the holding wall portion 18*b* comes into stable contact with the outer wall 2*g* of the jetty portion 5*a*. Such a structure is very preferable since the respective pin terminals 3 and the lead block 1 can be reliably mounted on the stationary-side housing 12 without rattling. Meanwhile, the recessed step 18*c* may be formed on the outer wall 2*g* of the jetty portion 5*a*.

Next, a procedure for mounting the lead block 1, which is connected to the end portion (outer end portion) of the flat cable 20, on the lower connector holding portion 12*a* of the stationary-side housing 12 will be described. First, the support member 2 is disposed in the receiving recess 17*b* (receiving portion) of the downward protruding portion 17*a* of the outer cylindrical portion 17, so that the lead block 1 connected to the flat cable 20 is positioned. Then, the lower cover 18 is mounted on the outer cylindrical portion 17 so that the tip portions 3*a* of the respective pin terminals 3 are inserted into the respective insertion holes 18*d* formed in the holding wall portion 18*b* of the downward protruding portion 18*a* of the lower cover 18. The mounting of the lead block 1 is performed when the outer cylindrical portion 17 of the stationary-side housing 12 and the lower cover 18 are integrated with each other by snap-fitting. That is, the support member 2 is disposed so as to be positioned in the receiving recess 17*b*. Then, the lower cover 18 is mounted on the outer cylindrical portion 17 so that the tip portions of the respective pin terminals 3 are inserted into the respective insertion holes 18*d* of the holding wall portion 18*b* of the downward protruding portion 18*a*, and the lead block 1 is mounted on the lower connector holding portion 12*a* when the lower connector holding portion 12*a* is assembled using the downward protruding portion 17*a* and the downward protruding portion 18*a*.

Since the insulating support member 2 molded using a simple mold can be applied to the lead block 1 of this embodiment as described above, insert molding does not need to be performed using a mold having a complicated structure. Further, since it is possible to manufacture the lead block 1 by fitting the plurality of pin terminals 3 to the support member 2 and holding the pin terminals 3, it is possible not only to significantly reduce the manufacturing costs of the lead block 1 but also to significantly reduce the manufacturing costs of the rotary connector 30. Furthermore, since the common support member 2 can be used even when a lead block 1 of which the number of pin terminals is different is manufactured, it is possible to further reduce the costs of the components. Accordingly, the rotary connector 30, which is very advantageous for the reduction of costs, is obtained.

Moreover, in this embodiment, the support member 2 is disposed so as to be positioned in the receiving recess 17*b* of the downward protruding portion 17*a* and the stopper portions 3*e* (restricting portions) of the respective pin terminals 3 are interposed between the holding wall portion 18*b* of the downward protruding portion 18*a* and the outer wall 2*g* of the support member 2 when the lead block 1 connected to the flat cable 20 is assembled in the lower connector holding portion 12*a* of the stationary-side housing 12. For this reason, even though a large external force (a pushing force or a pulling force) is applied to the pin terminals 3 when an external connector is connected to or disconnected from the respective pin terminals 3 protruding outward from the insertion holes 18*d* of the holding wall portion 18*b*, not only there is no concern that the pin terminals 3 are separated from the support member 2 and but also there is no concern that a conduction failure is caused by the separation of a welded portion between the joint portion 3*d* of the pin terminal 3 and the connection portion 21*a* of the belt-like conductor 21 of the flat cable 20. Accordingly, it is possible to connect and disconnect the external connector to and from the rotary connector 30 at ease.

Meanwhile, for example, the pin terminals of the lead block (not shown) connected to the other end portion of the flat cable 20, that is, the lead block assembled in the upper connector holding portion 11*a* of the movable-side housing 11 are formed in the shape of a crank in this embodiment. For this reason, even though the stopper portions (restricting portions) of the respective pin terminals of this lead block are not interposed at a part of the movable-side housing 11, there is no concern that the positions of the pin terminals are shifted relative to the support member at the time of the connection and disconnection of an external connector. However, when the pin terminals of the lead block (not shown) have a straight shape (linear shape), it is preferable that the stopper portions of the respective pin terminals are interposed using a part (for example, the upper rotor 15) of the movable-side housing 11 as in the lead block 1.

Further, in this embodiment, not only the mounting hole portions 9 to which the wedge-shaped portions 3*c* of the plurality of pin terminals 3 are tightly fitted but also the fitting portions 10 serving as holding portions, to which the base end portions 3*b* of the respective pin terminals 3 are press-fitted and which hold the respective pin terminals 3 so that the respective pin terminals 3 are arranged in parallel, are formed in the support member 2 of the lead block 1 connected to one end portion of the flat cable 20. For this reason, the mounting strength and mounting position accuracy of the pin terminals 3 on the support member 2 are increased. Meanwhile, the mounting hole portions 9 and the fitting portions 10 are formed as the holding portions in this embodiment, but the guide grooves 7 can also be applied as the holding portions as described above. Accordingly, both the fitting portions 2*c* and the guide grooves 7 may be used as the holding portion, and the holding portions may be formed of only the guide grooves 7.

Furthermore, when the lower cover 18 (first case body) and the outer cylindrical portion 17 (second case body) are connected to each other by snap-fitting while the support member 2 is positioned in this embodiment, the lead block 1 is easily mounted on the lower cover 18 and the outer cylindrical portion 17. Accordingly, this is preferable.

Next, a rotary connector 40 according to a second embodiment of the invention will be described with reference to FIGS. 7 to 10. Meanwhile, portions of FIGS. 7 to 10, which correspond to FIGS. 1 to 6, are denoted by the same reference numerals and the repeated description thereof will be appropriately omitted.

In the rotary connector 40 according to the second embodiment of the invention, a lead block 32 different from the lead block of the first embodiment is assembled in the upper connector holding portion 11*a* of the movable-side housing 11 and the other end portion (inner end portion) of the flat cable 20 is connected to the lead block 32.

Figure 9:
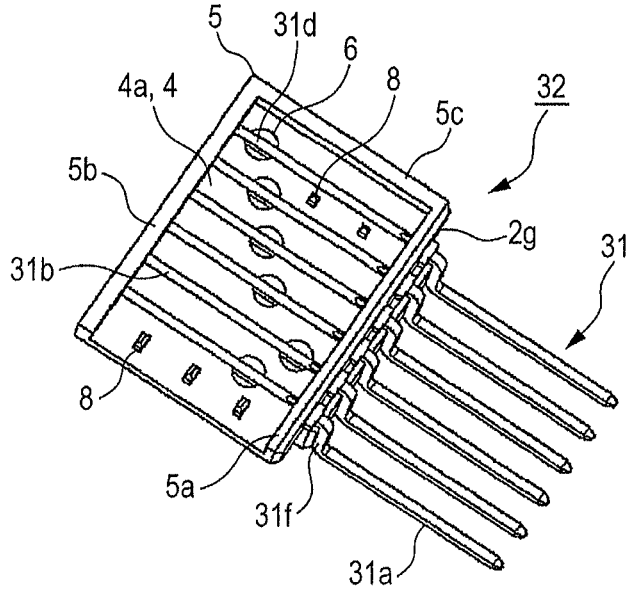
FIG. 9 is a perspective view of a lead block that is assembled in the rotary connector of FIG. 7.
Figure 10:
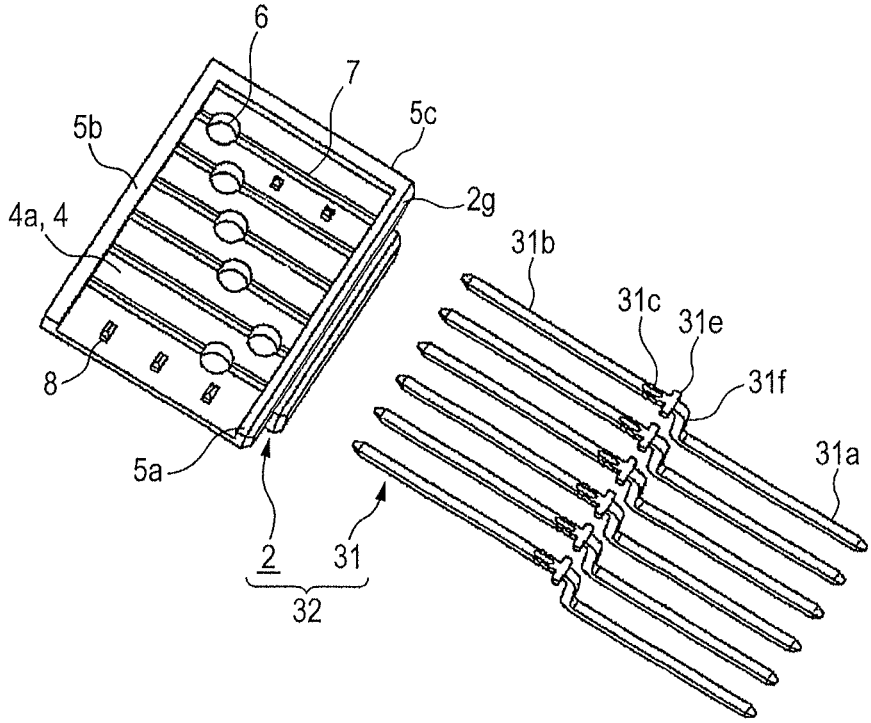
FIG. 10 is an exploded perspective view of the lead block shown in FIG. 9.

As shown in FIGS. 9 and 10, the lead block 32 of this embodiment includes a support member 2 that is formed of a molding made of an insulating resin, and a plurality of pin terminals 31 that are held by being fitted and fixed to the support member 2. The structure of the lead block 1 of the first embodiment is basically the same as that of the lead block 32 of the second embodiment except that each of the pin terminals 31 is formed in the shape of a crank. That is, the structure of the support member 2 is the same as that of the support member 2 shown in FIGS. 5 and 6, and the jetty portions 5 (5*a*, 5*b*, and 5*c*) are erected from the support member 2 along three sides of the bottom plate 4 except for one side of the bottom plate 4 that is a portion through which the flat cable 20 extends to the outside. The flat cable 20 is disposed so as to be superimposed on the inner surface portion 4*a* of the bottom plate 4 forming a region within the jetty portions 5.

However, base end portions 31*b*, which are held by the support member 2, and tip portions 31*a*, which protrude from the support member 2, of the plurality of pin terminals 31 are not aligned with each other. The tip portion 31*a* and the base end portion 31*b* are continuous to each other in the shape of a crank through a bent portion 31*f*. That is, each of the pin terminals 31 includes a base end portion 31*b* that is fitted to a fitting portion 10 of the support member 2, wedge-shaped portions 31*c* that hold the base end portion 31*b* on the support member 2 by biting into the inner surface of a mounting hole portion 9, a stopper portion 31*e* (restricting portion) that comes into contact with and is locked into the peripheral portion of the mounting hole portion 9, a bent portion 31*f* that is bent in an L shape from the stopper portion 31*e* and extends along the outer wall 2*g* of the support member 2, and a tip portion 3*a* that is bent in an L shape from the bent portion 31*f* and extends to the outside of the support member 2. The base end portion 31*b* and the tip portion 3*a* extend from both ends of the bent portion 31*f* in opposite directions so as to be parallel to each other.

A procedure for connecting the other end portion of the flat cable 20 to the lead block 32 is the same as the procedure for connecting one end portion of the flat cable 20 of the above-mentioned first embodiment to the lead block 1. First, the end portion of the flat cable 20 is disposed on an inner surface portion 4*a* (bottom plate 4) of the support member 2 and positioning protrusions 8 are inserted into the through holes 24. Accordingly, the end portion of the flat cable 20 is positioned relative to the support member 2 and the respective conductor exposure holes 23 are disposed immediately above the respective exposure hole portions 6. When the positioning protrusions 8 are thermally caulked in this state, the flat cable 20 is fixed to the bottom plate 4 of the support member 2 while being positioned on the bottom plate 4. Then, electrodes (not shown) of a spot welder are inserted into the exposure hole portion 6 and the conductor exposure hole 23, a joint portion 31*d* of the pin terminal 31 and the connection portion 21*a* of the belt-like conductor 21 come into press contact with each other, and the pair of electrodes apply current to the joint portion 31*d* and the connection portion 21*a* to perform spot welding. As a result, the joint portion 31*d* and the connection portion 21*a* are welded to each other.

Figure 7:
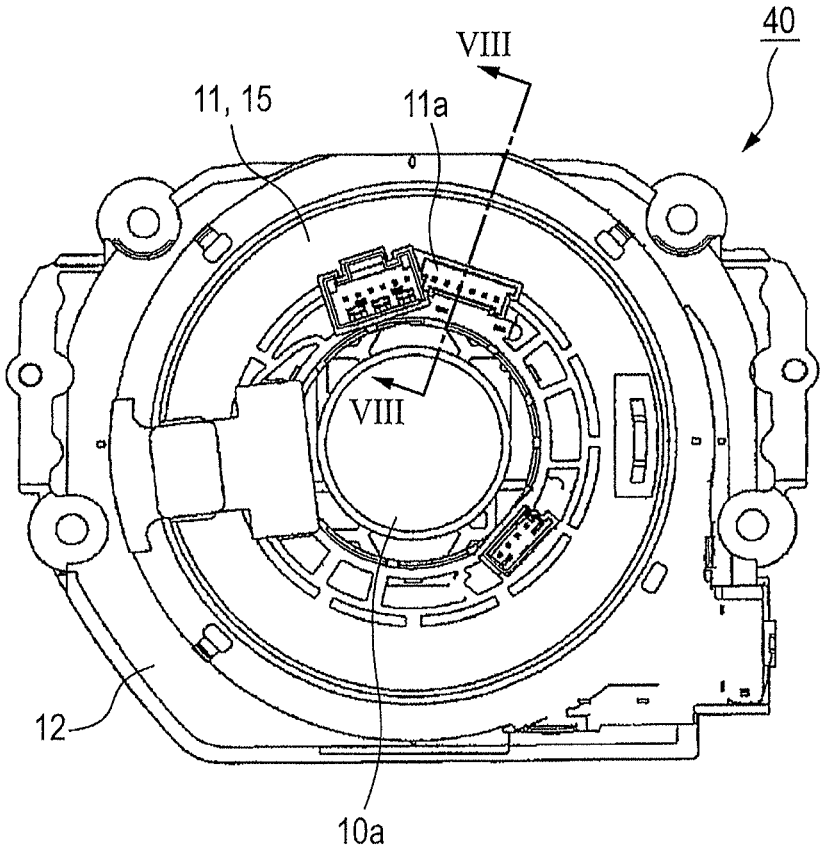
FIG. 7 is a plan view of a rotary connector according to a second embodiment of the invention.
Figure 8:
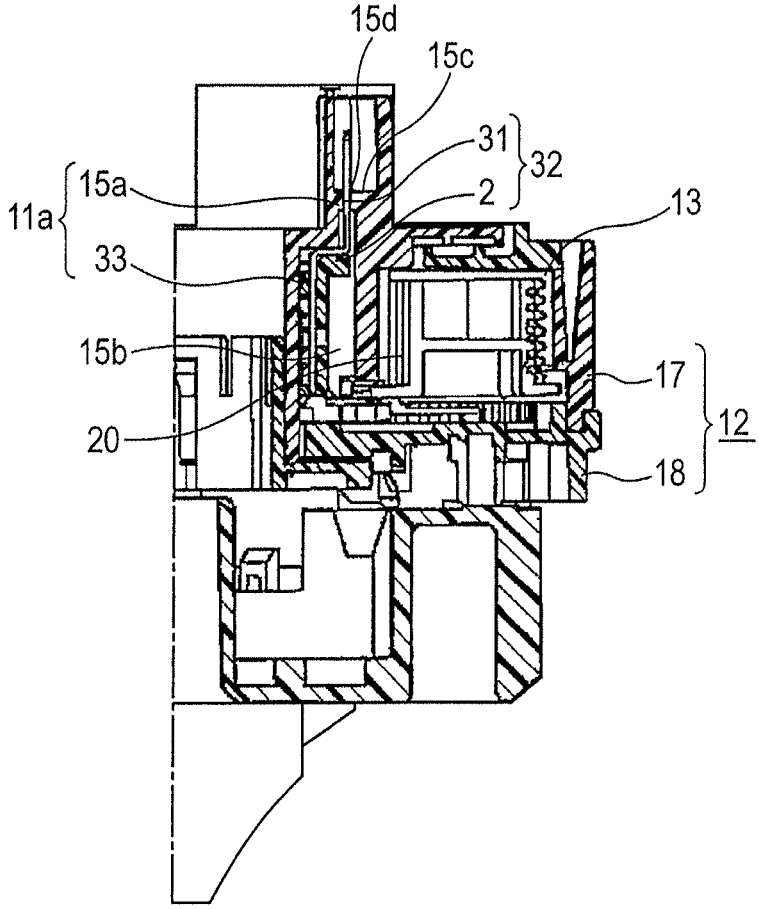
FIG. 8 is a cross-sectional view taken along line VIII-VIII of FIG. 7.

After being connected to the end portion (inner end portion) of the flat cable 20, the lead block 32 is assembled in an upper connector holding portion 11*a* that is formed so as to protrude upward from the movable-side housing 11 as shown in FIGS. 7 and 8. The upper connector holding portion 11*a* is formed by the combination of an upward protruding portion 15*a* (first case body) of the upper rotor 15 and a protective member 33 (second case body) that is integrated with the upper rotor 15 by snap-fitting. The end portion of the flat cable 20 is covered with the protective member 33. A receiving recess 15*b* is formed on the side of the protective member 33, and the support member 2 of the lead block 32 can be disposed so as to be positioned in the receiving recess 15*b*. Further, a holding wall portion 15*c* is formed on the inner bottom of the upward protruding portion 15*a*, and a plurality of insertion holes 15*d* into which the tip portions 31*a* of the respective pin terminals 31 are individually inserted are formed in the holding wall portion 15*c*. According to such a structure, the stopper portions 31*e* and the bent portions 31*f* of the respective pin terminals 31 are interposed between the holding wall portion 15*c* of the upward protruding portion 15*a* and the outer wall 2*g* of the support member 2. Accordingly, even though a large external force (a pushing force or a pulling force) is applied to the pin terminals 31 when an external connector is connected to or disconnected from the tip portions 31*a* of the respective pin terminals 31, not only there is no concern that the pin terminals 31 are separated from the support member 2 and but also there is no concern that a conduction failure is caused by the separation of a welded portion between the joint portion 31*d* of the pin terminal 31 and the connection portion 21*a* of the belt-like conductor 21 of the flat cable 20.

Meanwhile, in this embodiment, for a lead block (not shown) connected to one end portion (outer end portion) of the flat cable 20, that is, a lead block assembled in the lower connector holding portion 12*a* of the stationary-side housing 12, the same crank-shaped pin terminals 31 as the pin terminals of the lead block 32 may be used but the straight pin terminals 3 described in the first embodiment may be used.

It should be understood by those skilled in the art that various modifications, combinations, sub-combinations and alterations may occur depending on design requirements and other factors insofar as they are within the scope of the appended claims of the equivalents thereof.

What is claimed is:

1. A rotary connector comprising:

a movable-side housing and a stationary-side housing that are rotatably connected to each other;

a flat cable comprising a plurality of belt-like conductors, which are arranged in parallel, except for connection portions coated with a pair of insulating films and received in an annular space formed between both the housings while being wound; and a lead block that is connected to the connection portions of the flat cable and is electrically connected to the outside, wherein the lead block comprises a plurality of pin terminals arranged in parallel in an insulating support member, the flat cable and the lead block are superimposed so that the plurality of pin terminals and the plurality of belt-like conductors cross each other, the plurality of pin terminals include joint portions that are connected to the connection portions of the flat cable and are close to base end portions, fitting portions that are held by being fitted to the support member, restricting portions that come into contact with an outer wall of the support member, and tip portions that protrude outward from the restricting portions, and at least one of the movable-side housing and the stationary-side housing includes a receiving portion in which the lead block is received and a holding wall portion that includes insertion holes into which tip portions of the plurality of pin terminals are inserted, and the restricting portions are directly or indirectly interposed between the holding wall portion and the support member while the lead block is received.

2. The rotary connector according to claim 1, wherein the plurality of pin terminals extend linearly from the base end portions toward the tip portions, flange-like stopper portions are formed on linear portions of the pin terminals as the restricting portions, and the stopper portions are directly interposed between the holding wall portion and the support member.

3. The rotary connector according to claim 2, wherein at least one of the movable-side housing and the stationary-side housing includes a first case body and a second case body that are integrated with each other by snap-fitting, the receiving portion is formed in the second case body, the insertion holes are formed in the first case body, and the first and second case bodies form a connector holding portion that holds the lead block.

4. The rotary connector according to claim 1, wherein the restricting portions include bent portions each of which extends from the restricting portion along the outer wall of the support member, the fitting portions and the tip portions protrude from both ends of the bent portions in directions substantially orthogonal to each other, and at least the bent portions are interposed between the holding wall portion and the support member.

5. The rotary connector according to claim 4, wherein at least one of the movable-side housing and the stationary-side housing includes a first case body and a second case body that are integrated with each other by snap-fitting, the receiving portion is formed in the second case body, the insertion holes are formed in the first case body, and the first and second case bodies form a connector holding portion that holds the lead block.

6. The rotary connector according to claim 1, wherein the support member includes first holding portions which correspond to the tip portions of the plurality of pin terminals and to which the plurality of pin terminals are held by being fitted, and second holding portions which correspond to the base end portions of the plurality of pin terminals and hold the plurality of pin terminals so that the pin terminals are arranged parallel to each other.

7. The rotary connector according to claim 6, wherein the support member includes exposure hole portions that are provided so that the joint portions are disposed between the first and second holding portions, and guide grooves that guide the pin terminals so that the pin terminals are inserted while surfaces of the pin terminals are exposed to the outside when the plurality of pin terminals are inserted into the second holding portions from the first holding portions, and the fitting portions of the plurality of pin terminals bite into inner surfaces of the first holding portions so that the plurality of pin terminals are held.

* * * * *

UNITED STATES PATENT AND TRADEMARK OFFICE

CERTIFICATE OF CORRECTION

PATENT NO. : 8,888,518 B2
APPLICATION NO. : 13/788559
DATED : November 18, 2014
INVENTOR(S) : Seishi Takahashi et al.

It is certified that error appears in the above-identified patent and that said Letters Patent is hereby corrected as shown below:

On the Title Page

Left column, insert new item as follows:

item [30] -- Foreign Application Priority Data

March 9, 2012 (JP) 2012-053487 --.

Signed and Sealed this
Seventh Day of April, 2015

Michelle K. Lee

Michelle K. Lee
*Director of the United States Patent and Trademark Office*